US006361270B1

(12) United States Patent
Bennett

(10) Patent No.: US 6,361,270 B1
(45) Date of Patent: Mar. 26, 2002

(54) CENTRIFUGAL PUMP FOR A GAS TURBINE ENGINE

(75) Inventor: George L. Bennett, Hebron, CT (US)

(73) Assignee: Coltec Industries, Inc., Charlotte, NC (US)

( * ) Notice: Subject to any disclaimer, the term of this patent is extended or adjusted under 35 U.S.C. 154(b) by 0 days.

(21) Appl. No.: 09/654,598

(22) Filed: Sep. 1, 2000

Related U.S. Application Data

(60) Provisional application No. 60/151,998, filed on Sep. 1, 1999.

(51) Int. Cl.[7] ..... F04D 29/44

(52) U.S. Cl. ..... 415/57.2; 415/57.1; 415/58.1; 415/58.2; 415/58.3; 415/58.4; 415/59.1; 415/143; 415/144; 416/183; 416/185; 416/186 R; 416/223 B

(58) Field of Search ..... 415/143, 144, 415/57.1, 57.2, 28.1, 58.2, 58.3, 58.4, 59.1; 416/183, 185, 186 R, 175, 203, 223 B

(56) References Cited

U.S. PATENT DOCUMENTS

| | | | | |
|---|---|---|---|---|
| 1,635,655 A | * | 7/1927 | Yates | 415/57.1 |
| 2,306,951 A | | 12/1942 | Jennings | |
| 2,826,147 A | * | 3/1958 | Gaubatz | 415/58.4 |
| 3,647,314 A | | 3/1972 | Laessig | |
| 3,656,861 A | | 4/1972 | Zagar | |
| 3,788,765 A | | 1/1974 | Rusak | |
| 4,149,825 A | | 4/1979 | Grennan | |
| 4,150,916 A | | 4/1979 | Tsutsui et al. | |
| 4,375,938 A | * | 3/1983 | Dussord | 415/58.4 |
| 4,408,953 A | | 10/1983 | Nasvytis et al. | |
| 4,475,868 A | | 10/1984 | Renger | |
| 4,642,023 A | | 2/1987 | Dunn | |
| 4,789,301 A | | 12/1988 | Osborne et al. | |
| 4,877,368 A | * | 10/1989 | Timperi et al. | 415/143 |
| 5,413,466 A | | 5/1995 | Bennett et al. | |
| 5,599,164 A | | 2/1997 | Murray | |
| 5,673,559 A | | 10/1997 | Benson | |
| 5,779,440 A | | 7/1998 | Stricker et al. | |

FOREIGN PATENT DOCUMENTS

| | | | | |
|---|---|---|---|---|
| CH | 100 769 | | 8/1923 | |
| DE | 198 18 667 | | 10/1999 | |
| FR | 404 632 | | 12/1909 | |
| GB | 658843 A | * | 10/1951 | 416/186 R |
| GB | 1 039 473 | | 8/1966 | |
| SE | 108 042 | | 7/1943 | |
| SU | 1073495 A | * | 2/1984 | 416/183 |
| SU | 1231273 A | * | 5/1986 | 416/183 |

OTHER PUBLICATIONS

International Search Report for application No. PCT/US00/23910, Dec. 8, 2000.

* cited by examiner

*Primary Examiner*—Christopher Verdier
(74) *Attorney, Agent, or Firm*—Cummings & Lockwood

(57) ABSTRACT

A centrifugal pump for a gas turbine engine, including a housing having a fluid inlet port for receiving fluid at an initial pressure and an interior chamber defining a central axis. An impeller disk disposed within the interior chamber of the housing and mounted for rotation about the central axis. The impeller disk defines first and second inlet areas and has a plurality of circumferentially spaced apart channels formed therein which extend from the inlet areas for conducting fluid from the inlet areas in a radially outward direction upon rotation of the impeller disk so as to increase the pressure of the fluid. A first collector is formed by the housing for receiving the fluid from the first inlet area via the channels at a first elevated pressure relative to the initial pressure and a second collector is formed by the housing for receiving fluid from the second inlet area via the channels at a second elevated pressure relative to the first elevated pressure. A cross-over conduit is formed by the housing for conducting fluid from the first collector to the second inlet area of the impeller disk and an outlet is formed by the housing for conducting fluid from the second collector.

22 Claims, 5 Drawing Sheets

CENTRIFUGAL PUMP FOR A GAS TURBINE ENGINE

CROSS-REFERENCE TO RELATED APPLICATION

This application claims priority to U.S. Provisional Patent Application No. 60/151,998, filed Sep. 1, 1999, which is incorporated herein by reference in its entirety.

BACKGROUND OF THE INVENTION

1. Field of the Invention

The present disclosure relates to a centrifugal pump, and more particularly, to a low specific speed centrifugal pump for use in conjunction with a fuel metering unit for a gas turbine engine.

2. Background of the Disclosure

Pumps have been widely used and are well understood in the art. They are utilized in a variety of applications such as petroleum refining plants and combustion engines. In use, pumps increase the flow and/or pressure of a fluid within a system in order to adequately supply a device which requires fluid with an increased fluid flow and/or pressure.

The present disclosure involves booster pumps. The term "booster" is used to describe various applications. A "booster stage" may mean a separate secondary pump on the inlet of a primary pump to further increase the net positive suction head (hereinafter "NPSH") to the inlet of the primary pump. Traditionally, one employed low specific speed centrifugal pumps as the "boost stage" of a fuel metering unit for small gas turbine engines. Such centrifugal pumps are typically low speed (e.g., 6,000–12,000 rpm) and low volumetric flow, yet the boost stage must produce a relatively high pressure rise (e.g., 200 psid). A "booster" may also refer to a suction device, such as an inducer, incorporated as part of a primary pump to improve its NPSH. Further, a secondary pump or impeller downstream and in series with the primary pump to increase discharge pressure is also called a "booster".

Several systems have been developed to more efficiently and cost effectively energize a fluid pathway. For example, U.S. Pat. No. 5,779,440 to Stricker et al. discloses means for forming jet sheets upstream of an impeller. The device includes a recirculation chamber surrounding an impeller shroud for recirculating fluid back through the impeller. It is also common for pumps to have multiple impellers in series which move the same fluid, e.g., "multi-stage" pumps. Multistage pumps further increase the flow and pressure of fluid. U.S. Pat. No. 5,599,164 to Murray shows a multi-stage centrifugal pump assembly including primary and booster impellers, wherein the inlet of the secondary impeller is connected to the outlet of the primary impeller.

Despite their utility, there are disadvantages associated with these prior art systems. For example, multiple impellers increase cost, complexity and require additional drive mechanism horsepower. Additional complexity involves more costly maintenance creating an undesirably high cost of ownership. Prior art pumps are inefficient. Pump efficiency is the pump output in terms of liquid horsepower compared to the horsepower delivered to the drive shaft. Seal and windage loss decrease efficiency. Seal loss is the fluid leakage from higher pressurized areas to lower pressurized areas. Windage, the drop in efficiency due to impeller friction, is the predominant type of loss in many pumps. In particular, relatively large diameter impellers and relatively narrow width impeller blades which are necessary to achieve the desired performance increase windage which reduces efficiency. In addition, temperature increases for the fluid can occur as the fluid is pumped through the fluid. In many instances, such temperature increases are undesirable.

In view of the foregoing deficiencies, there is a need for a compact, lightweight, economical and reliable low specific speed centrifugal pump with improved efficiency, and which does not increase the temperature of the fluid pumped thereby.

SUMMARY OF THE INVENTION

The present invention provides a centrifugal pump for a gas turbine engine, including a housing having a fluid inlet port for receiving fluid at an initial pressure and an interior chamber defining a central axis. An impeller disk disposed within the interior chamber of the housing and mounted for rotation about the central axis. The impeller disk defines first and second inlet areas and has a plurality of circumferentially spaced apart channels formed therein which extend from the inlet areas for conducting fluid from the inlet areas in a radially outward direction upon rotation of the impeller disk so as to increase the pressure of the fluid. A first collector is formed by the housing for receiving the fluid from the first inlet area via the channels at a first elevated pressure relative to the initial pressure and a second collector is formed by the housing for receiving fluid from the second inlet area via the channels at a second elevated pressure relative to the first elevated pressure. A cross-over conduit is formed by the housing for conducting fluid from the first collector to the second inlet area of the impeller disk and an outlet is formed by the housing for conducting fluid from the second collector.

Preferably, the plurality of circumferentially spaced apart channels are bifurcated adjacent an outer diameter of the impeller and the impeller is configured in such a manner so that at least seventy percent of the circumferentially spaced apart channels are in fluid communication with the first and second inlet areas. In yet another embodiment, the first collector and the second collector are diametrically opposed from one another relative to the central axis of the housing.

In another embodiment, the housing further defines sealing lands with the impeller disk for sealingly isolating the first and second collectors. In another embodiment, the impeller disk may be shrouded, unshrouded or open. The plurality of circumferentially spaced apart channels are preferably adapted and configured to facilitate fluid communication between the first inlet area and the first collector, and between the second inlet area and the second collector.

Still another embodiment of the present invention includes a device which comprises an inducer, having a helical blade extending radially outward, rotatably mounted about the central axis of the housing for drawing fluid axially from the fluid inlet port to the first inlet area of the impeller disk.

And yet another embodiment of the present invention includes a housing with a partition within the interior chamber for isolating the first inlet area from the second inlet area. Preferably, the partition defines a third inlet area, the outlet conducts fluid from the second collector to the third inlet area and the housing defines a third collector outward of the impeller for receiving the fluid passed through the impeller from the third inlet area and a second outlet formed by the housing for conducting fluid from the third collector. It is also envisioned that a first elevated pressure outlet may be provided for conducting the fluid from the first collector to allow the centrifugal pump to supply the fluid at the first elevated pressure and the second elevated pressure.

BRIEF DESCRIPTION OF THE DRAWINGS

So that those having ordinary skill in the art to which the low speed specific centrifugal pump of which the subject invention appertains, reference may be had to the accompanying drawings wherein.

DETAILED DESCRIPTION OF THE DISCLOSURE

Figure 1:
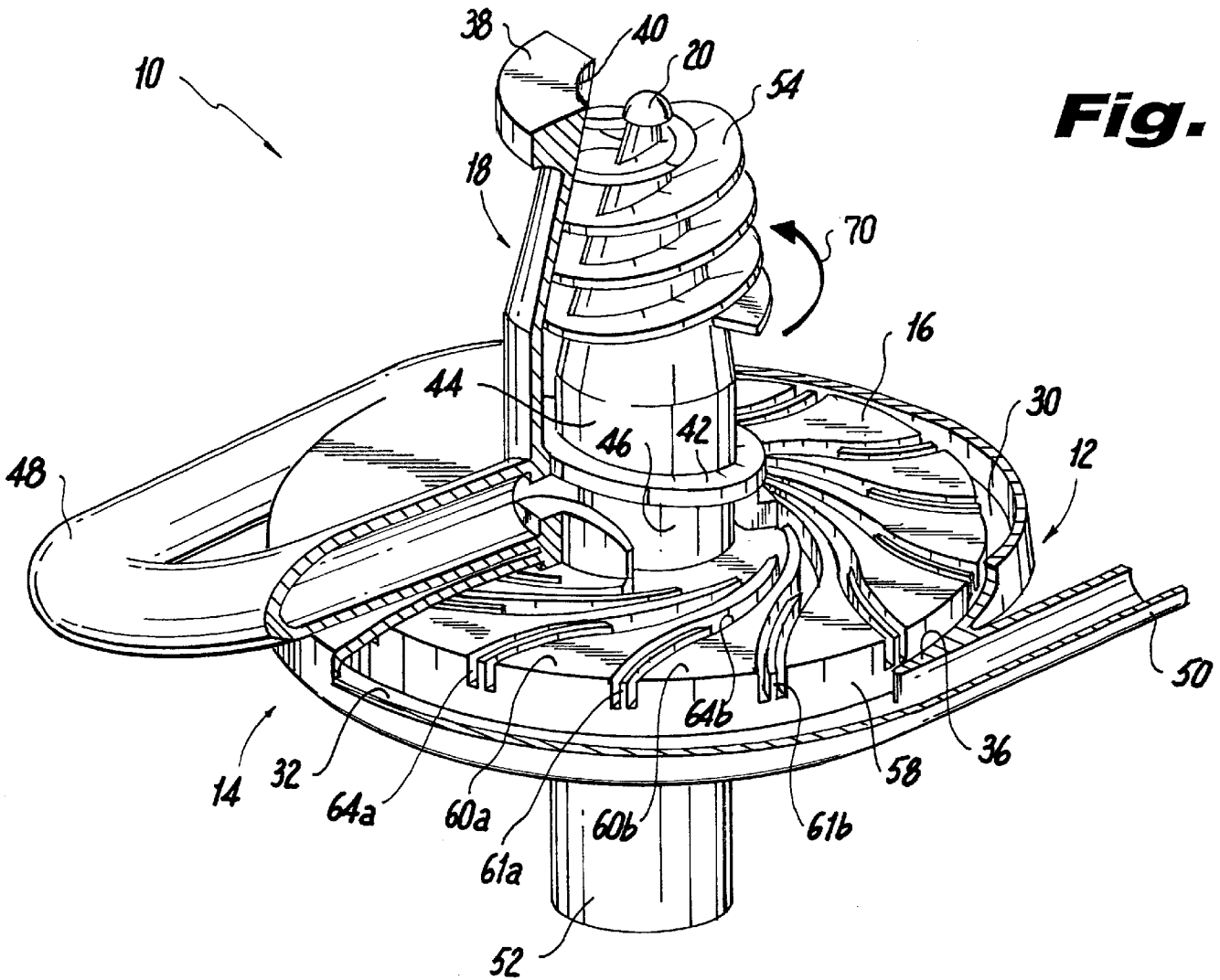
FIG. 1 is a perspective view of a low specific speed centrifugal pump constructed in accordance with a preferred embodiment of the subject invention, with a housing of the pump cut-away to reveal an inducer and an impeller therein.

The present invention relates to an improved boost pump for increasing the pressure of a fluid. The system is particularly applicable to supplying fluid to a fuel metering unit for use with a small gas turbine engine, although the system and method may be utilized in many applications, such as low specific speed centrifugal pumps for use as a "boost stage" with large gas turbine engines, as would be readily appreciated by those skilled in the art.

The present invention overcomes many problems of the prior art associated with pumps. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Figure 2:
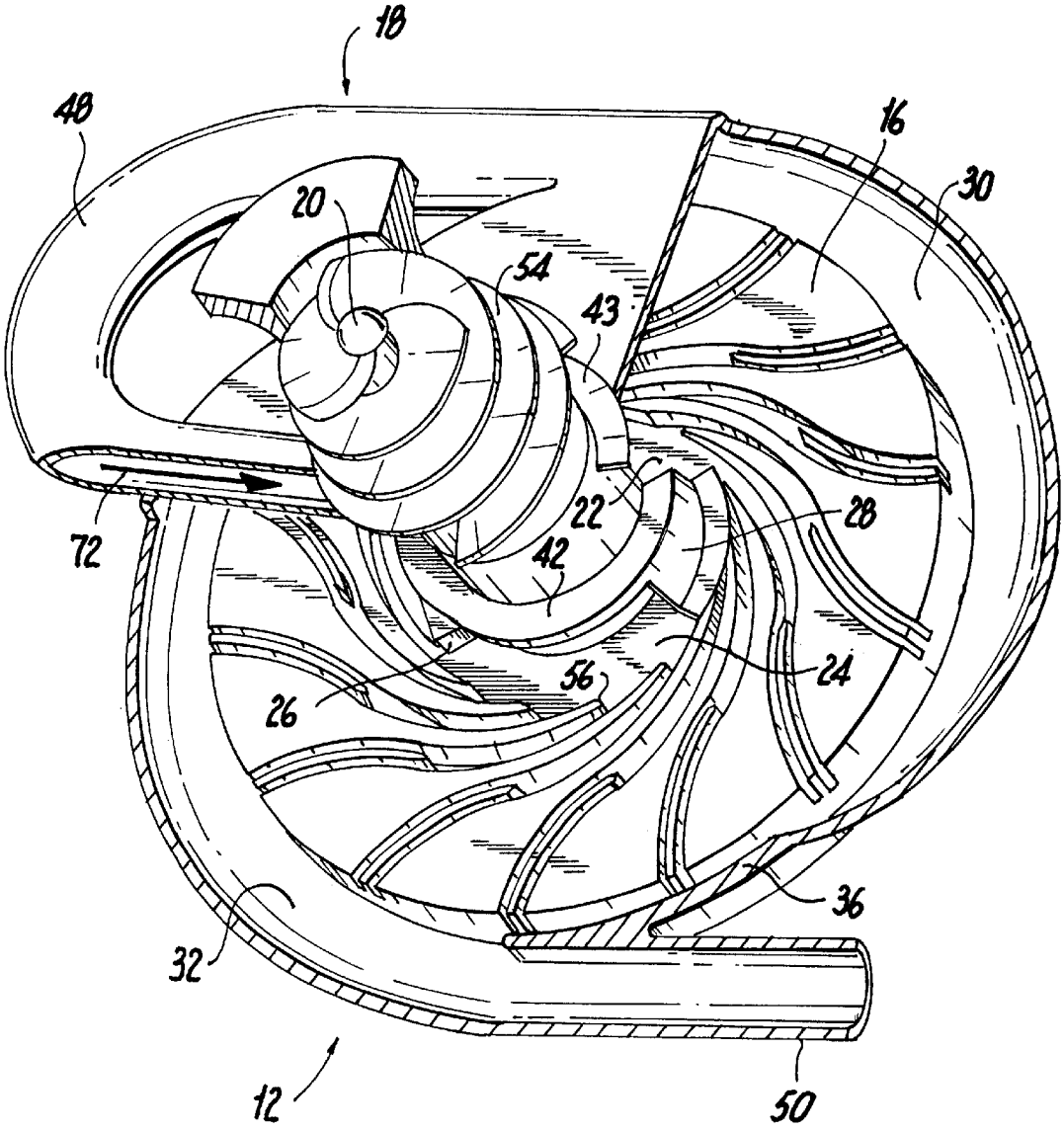
FIG. 2 is another perspective view of the low specific speed centrifugal pump of FIG. 1, with the housing of the pump cut-away to reveal a sealing landing.

Referring to FIGS. 1 and 2, there is illustrated a low specific speed centrifugal pump 10 with the housing cut away for ease of illustration. Centrifugal pump 10 is intended for use as a secondary pump to increase the initial fluid pressure at the main pump, e.g., "a boost stage" for a fuel metering system of a gas turbine engine (not shown). Centrifugal pump 10 includes a generally cylindrical housing 12 having an impeller casing 14 configured to surround a disk-like impeller 16, and a substantially funnel-shaped inducer casing 18 for surrounding an inducer 20. Inducer 20 and impeller 16 are mounted for rotation about a common axis on a drive shaft 52 in the direction indicated by the arrow designated 70. In a preferred embodiment, when inducer 20 and impeller 16 are rotating, fluid is drawn into pump 10 and the pressure of the fluid is elevated to 100 to 200 psid. Drive shaft 52 extends through a bore in housing 12 to connect to a drive motor (not shown) for supplying torque to the drive shaft 52. Drive shaft 52 typically rotates at a low speed (e.g., within the range of 6,000 to 12,000 rpm).

Still referring to FIGS. 1 and 2, impeller casing 14 defines first and second collector areas 30 and 32, respectively. The first and second collector areas 30 and 32 extend outside the outer diameter of impeller 16. In a preferred embodiment, the first and second collector areas 30 and 32 are diametrically opposed, however they may be arranged in a different manner. Inducer casing 18 extends from impeller casing 14, and defines pump inlet 40 and top end 38. During operation, fluid enters pump 10 via pump inlet 40. Adjacent to pump inlet 40, inducer 20 includes blades 54 which extend radially outward. When rotating on drive shaft 52, inducer 20 reduces the NPSH requirement of pump 10 and charge impeller 16 with fluid at sufficient pressure. In an alternative embodiment of the subject invention, the pump does not include an inducer. Therefore, the incoming fluid is conducted towards impeller 16 under its own pressure.

Still referring to FIGS. 1 and 2, sealing land 42 is operatively associated with inducer casing 18. Sealing land 42 includes upstanding helical flange 43 which surrounds inducer 20 to divide an interior of inducer casing 18 into a first portion 44 adjacent top end 38, and a second portion 46 adjacent impeller 16. Upstanding helical flange 43 directs fluid from pump inlet 40 to first inlet area 22. Sealing land 42 also includes shoulders 26 and 28 located within the inner diameter 56 of impeller 16 for defining the first and second inlet areas 22 and 24. The radially outwardly facing portions of shoulders 26 and 28 form non-contacting seals with inner diameter 56 of impeller 16. Similarly, the radially inwardly facing portions of shoulders 26 and 28 form non-contacting seals with inducer 20. As a result, shoulders 26 and 28 partition the first and second inlet areas 22 and 24 to substantially prevent leakage therebetween.

Housing 12 also includes a cross-over conduit 48 providing fluid communication between first collector area 30 and second portion 46 of inducer casing 18. Cross-over conduit 48 allows fluid to pass from first collector area 30 to second inlet area 24 in the direction indicated by the arrow designated 72. Upstanding helical flange 43 and shoulders 26 and 28 combine with one another to prevent the fluid exiting crossover conduit 48 from leaking into first inlet area 22. Pump outlet conduit 50 conducts fluid out from second collector area 32 of impeller casing 14.

Figure 3:
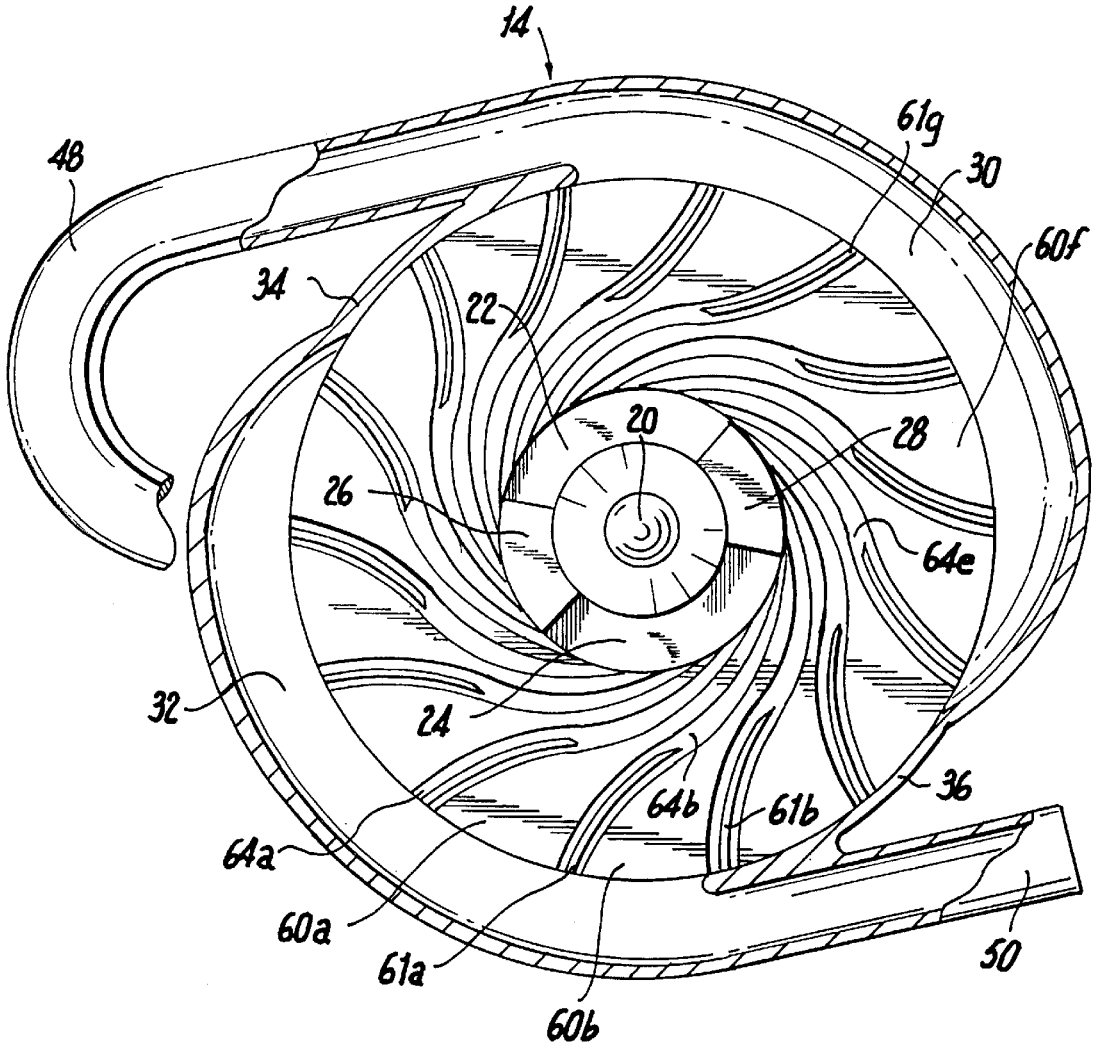
FIG. 3 is a cross-sectional view of the low specific speed centrifugal pump of FIG. 1.

Referring to FIG. 3, impeller 16 includes a plurality of major radial vanes 60(*a*)–(*n*) and minor radial vanes 61(*a*)–(*n*). Major radial vanes 60(*a*)–(*n*) and minor radial vanes 61(*a*)–(*n*) define a plurality of corresponding bifurcated flow channels 64(*a*)–(*n*). For simplicity, not all of major radial vanes 60(*a*)–(*n*), minor radial vanes 61(*a*)–(*n*) and bifurcated flow channels 64(*a*)–(*n*) are labeled on the figures. The variable "n" is used for illustration and should not be considered a limitation in any way to the number of vanes or channels present in impeller 16. Preferably, on the side opposing inducer 20, impeller 16 is uniform thereby corresponding to the class of impellers known as unshrouded. In another embodiment, the impeller is comprised of one uniform disc mounted as a backing for a disc with a plurality of vanes. However, it is also envisioned that an impeller having no disc (e.g., an open impeller), having a disc on each side (e.g., a shrouded impeller) or having a disk with channels on both sides (e.g., vertical stage) could be provided. Each different type of impeller may be thin-channel as illustrated in the figures or other conventional type such as a vane impeller.

With continuing reference to FIG. 3, channels 64(*a*)–(*n*) of impeller 16 provide fluid communication between first inlet area 22 and first collector area 30 of impeller casing 14, and between second inlet area 24 and second collector area 32. The plurality of major radial vanes 60(*a*)–(*n*) and minor radial vanes 61(*a*)–(*n*) are arranged and configured such that as impeller 16 rotates about the shaft 52, the inner ends of each channel 64(*a*)–(*n*) are in fluid communication with first inlet area 22, and the corresponding outer ends are in fluid communication with first outlet area 30. Similarly, when inner ends of each channel 64(*a*)–(*n*) are in fluid communication with second inlet area 24, corresponding outer ends are in fluid communication with second outlet area 32. Preferably, at least 70% of channels 64(*a*)–(*n*) are in fluid communication with an inlet area at all times. First and second collector areas 30 and 32 are separated by inwardly facing sealing lands 34 and 36 to prevent leakage of fluid therebetween. In particular, the outer diameter of impeller 16 forms a non-contacting seal with sealing lands 34 and 36 of impeller casing 14.

Figure 4:
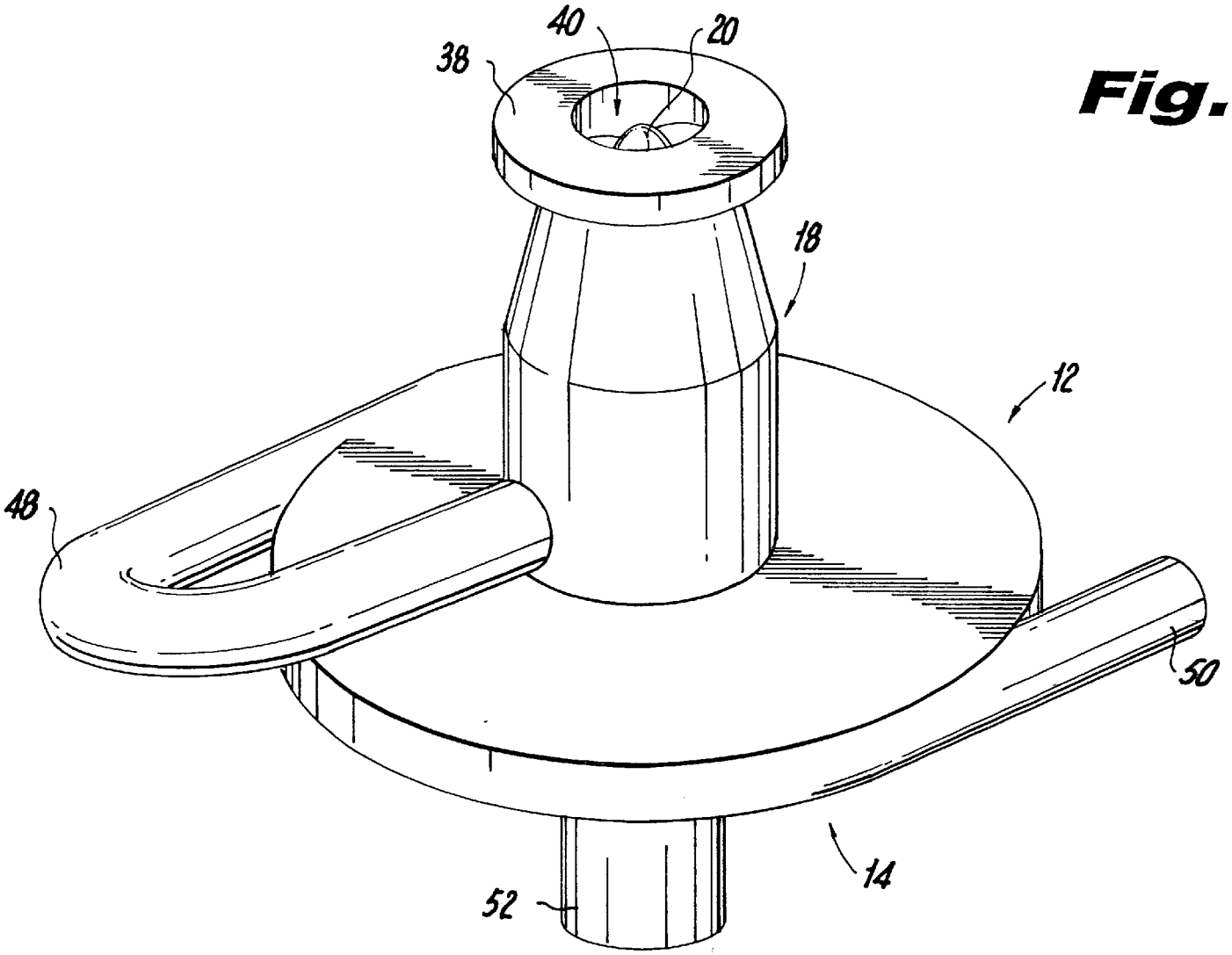
FIG. 4 is another perspective view of the low specific speed centrifugal pump of FIG. 1, illustrating the pump in a fully assembled condition.

Referring to FIG. 4, there is illustrated a perspective view of an assembled low specific speed centrifugal pump 10 constructed in accordance with the present disclosure. It is envisioned and well within the scope of the subject disclosure that housing 12, impeller 16 and inducer 20 may be of monolithic construction. Alternatively, funnel shaped inducer casing 18 may be threadably engaged to disk shaped portion 14 and cross-over conduit 48 may press fit to inducer casing 18. Further, disk shaped portion 14 may be formed from component pieces that are threadably engaged or press fit to one another. Similarly, collar 38 for sealingly engaging a fluid supply may attach to inducer casing 18 by press fit or threads. As such, it will be appreciated by those skilled in the art that various structures and methods may be used to construct housing 12 without deviating from the scope or spirit of the invention.

In operation, torque is supplied to drive shaft 52 of pump 10 by a drive motor (not shown). Drive shaft 52 rotates inducer 20 and impeller 16 about a common axis. A fluid, e.g., a liquid fuel, is introduced through pump inlet 40 and pumped axially inward by inducer 20 to first portion 44 of inducer casing 18. Inducer 20 and helical flange 43 direct the fluid through first portion 44 into first inlet area 22 where the only exit path is into the channels 64(*a*)–(*n*) of rotating impeller 16. Upon entering channels 64(*a*)–(*n*), the fluid is directed radially outwardly from the first inlet area 22 and accumulated within the first collector area 30 of impeller casing 14. Directing the fluid radially outward increases the fluid pressure. Within first collector area 30, the pressure of the fluid is increased approximately 50% of the total pressure increase provided by centrifugal pump 10.

Cross-over conduit 48 diffuses the flow of the partially pressurized fluid and conducts the fluid from first collector area 30 to the second portion 46 of inducer casing 18 where it is directed to second inlet area 24. From the second inlet area 24, the fluid is again directed radially outwardly through channels 64(*a*)–(*n*) of rotating impeller 16 to further increase the fluid pressure. However, here, the fluid passes from the second inlet area 24 to second collector area 32. When the fluid reaches the second outlet area 32, centrifugal pump 10 has increased the pressure of the fluid to the desired level. From there, pump outlet conduit 50 conducts the fully pressurized fluid from second collector area 32 to another device in the fluid path, such as, into the main pump and fuel metering means of a gas turbine engine.

Theory indicates that the centrifugal pump 10 of the present disclosure results in an impeller 16 having a diameter that is about thirty percent less than the diameter of an impeller of presently existing pumps producing similar pressure rises. Thus, windage loss is substantially reduced. Pump 10 also results in approximately twice the overall efficiency of existing pumps producing a similar pressure rise, while producing half the temperature rise in the fluid being pumped.

In another embodiment, low specific speed centrifugal pump may include more than one cross-over conduit. It is envisioned that a pump according to the present disclosure can have multiple cross-over conduits and an impeller casing with a corresponding number of inlet areas and collector areas. The total number of cross-over conduits employed is limited only by geometric considerations and proper pump design practice, as will be appreciated by those skilled in the art.

Figure 5:
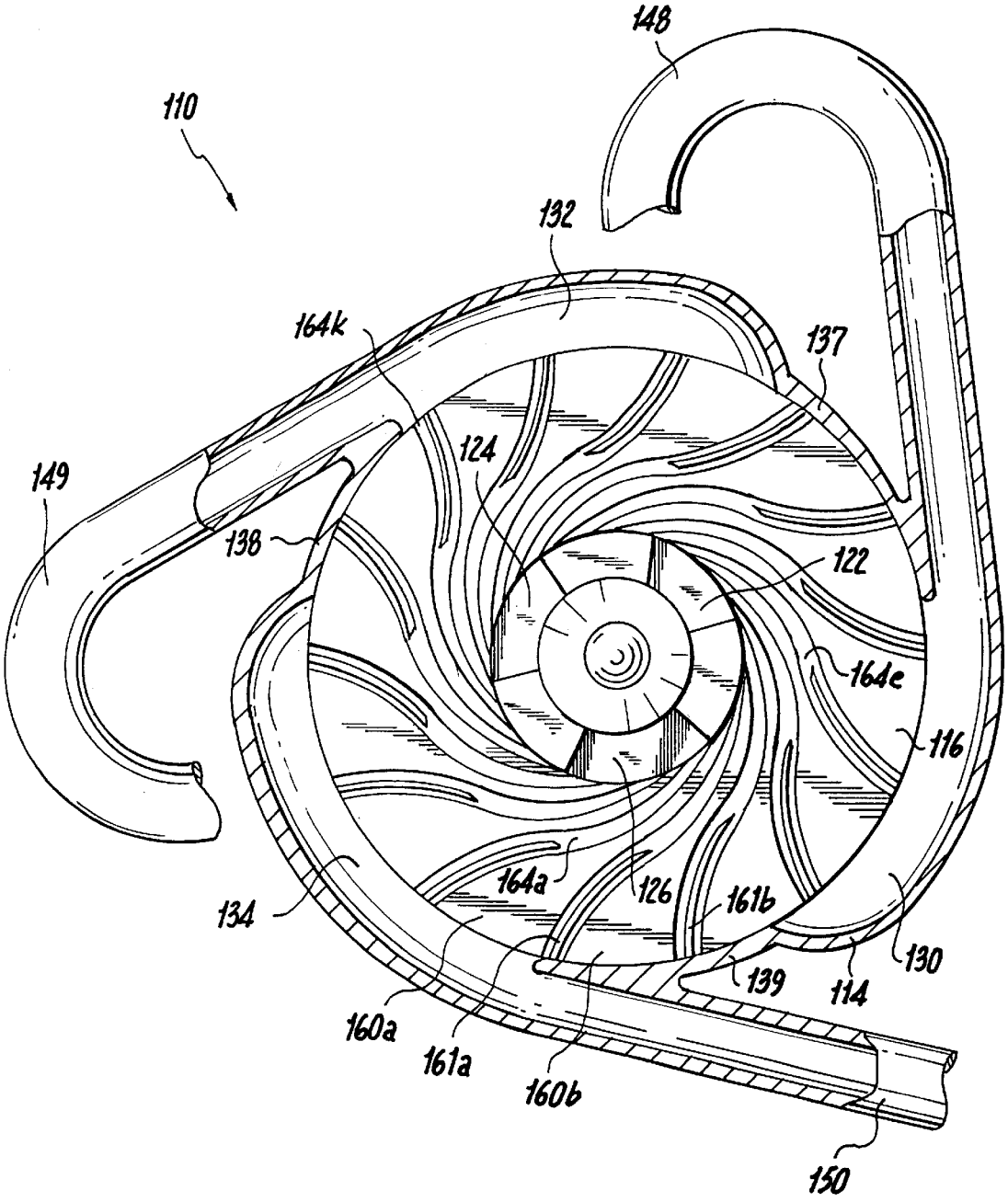
FIG. 5 is a schematic view of a multiple cross-over conduit pump constructed in accordance with a preferred embodiment of the subject invention.

For example, referring to FIG. 5, a pump 110 with two cross-over conduits in accordance with the subject invention is illustrated schematically. Channels 164(*a*)–(*n*) of impeller 116 provide fluid communication between first inlet area 122 and first collector area 130 of impeller casing 114, between second inlet area 124 and second collector area 132, and between third inlet area 126 and third collector area 134. In particular, the plurality of major radial vanes 160(*a*)–(*n*) and minor radial vanes 161(*a*)–(*n*) are arranged and configured such that as impeller 116 rotates, the inner ends of each of channel 164(*a*)–(*n*) are in fluid communication with first inlet area 122, and the corresponding outer ends are in fluid communication with first outlet area 130. Similarly, when inside ends of each of channels 164(*a*)–(*n*) are in fluid communication with second inlet area 124, corresponding outer ends are in fluid communication with second outlet area 132. Further similarly, when inside ends of each of channels 164(*a*)–(*n*) are in fluid communication with third inlet area 126, corresponding outer ends are in fluid communication with third outlet area 134. First, second and third collector areas 130, 132 and 134 are separated by inwardly facing sealing lands 137, 138 and 139 to prevent leakage of fluid therebetween. In particular, the outer diameter of impeller 116 forms a non-contacting seal with sealing lands 137, 138 and 139 of impeller casing 114. Cross-over conduit 148 conducts the fluid from the first collector area 130 to the second inlet area 124 of impeller casing 114. Similarly, cross-over conduit 149 conducts the fluid from the second collector area 132 to the third inlet area 126 of impeller casing 114. Outlet conduit 150 conducts the fully pressurized fluid from the third collector area 134.

In yet another embodiment, a pump according to the present disclosure may be provided with a vertical stage impeller wherein the outlet conduit would direct the fluid to an inlet area on the opposite side of the impeller where the fluid would be passed through the impeller again for further pressurization. The disk of the vertical stage impeller sealingly isolates the top and bottom sides of the impeller. Additionally, the opposite side may include additional conduits to route the fluid to and from multiple inlet areas and collectors to highly pressurize the fluid.

In still another embodiment, a pump according to the present disclosure may be provided without an inducer or inducer casing. In such an embodiment, pump inlet would connect directly to the first inlet area and the cross-over conduit would connect directly to the second inlet area. Additionally, a pump according to the present disclosure may be provided with an outlet conduit in fluid communication with the first collector area. As a result, the pump would provide two fluid streams at different pressures.

Although, the subject disclosure relates to boost stages, those skilled in the art will readily apply the disclosure to use in a main pump. Those skilled in the art will also appreciate that the subject disclosure is equally applicable to compressors. Such a compressor may have application in turbines, automotive air conditioners, refrigeration units and the like.

While the presently disclosed low specific speed centrifugal pump has been described in connection with a preferred embodiment, such is intended to be exemplary only and not definitive and it will be appreciated by those skilled in the art that many modifications, changes and substitutions may be made thereto without departing from the spirit or scope of the invention as defined by the appended claims.

What is claimed is:

1. A centrifugal turbo machine for increasing the pressure of a fluid, comprising:

a) a housing having a fluid inlet port for receiving fluid at an initial pressure and an interior chamber defining a central axis;

b) an impeller disk disposed within the interior chamber of the housing and mounted for rotation about the central axis, the impeller disk defining first and second inlet areas and having opposed, upper and lower disk surfaces, the upper surface having a plurality of circumferentially spaced apart channels formed therein for conducting fluid from the inlet areas in a radially outward direction upon rotation of the impeller disk so as to increase fluid pressure, wherein the plurality of circumferentially spaced apart channels are defined between the upper and lower disk surfaces;

c) a first collector formed by the housing for receiving the fluid from the first inlet area via the channels at a first elevated pressure relative to the initial pressure;

d) a second collector formed by the housing for receiving fluid from the second inlet area via the channels at a second elevated pressure relative to the first elevated pressure;

e) a cross-over conduit formed by the housing for conducting fluid from the first collector to the second inlet area of the impeller disk; and f) an outlet formed by the housing for conducting fluid from the second collector.

2. A centrifugal turbo machine as recited in claim 1, wherein the housing further defines sealing lands with the impeller disk for sealingly isolating the first and second collectors.

3. A centrifugal turbo machine as recited in claim 1, wherein the impeller disk is selected from the group of impellers consisting of shrouded, unshrouded and open.

4. A centrifugal turbo machine as recited in claim 1, wherein the plurality of circumferentially spaced apart channels are adapted and configured to facilitate fluid communication between the first inlet area and the first collector, and between the second inlet area and the second collector.

5. A centrifugal turbo machine as recited in claim 1, further comprising an inducer, having a helical blade extending radially outward, rotatably mounted about the central axis of the housing for drawing fluid axially from the fluid inlet port to the first inlet area of the impeller disk.

6. A centrifugal turbo machine as recited in claim 5, further comprising a partition, formed by the housing within the interior chamber for isolating the first inlet area from the second inlet area, having a helical flange for isolating a top of the inducer in fluid communication with the first inlet area and for isolating a bottom of the inducer in fluid communication with the second inlet area.

7. A centrifugal turbo machine as recited in claim 1, wherein the housing further includes a partition within the interior chamber for isolating the first inlet area from the second inlet area.

8. A centrifugal turbo machine as recited in claim 7, wherein the partition defines a third inlet area, the outlet conducts fluid from the second collector to the third inlet area and the housing defines a third collector outward of the impeller for receiving the fluid passed through the impeller from the third inlet area and a second outlet formed by the housing for conducting fluid from the third collector.

9. A centrifugal turbo machine as recited in claim 1, further comprising a first elevated pressure outlet for conducting the fluid from the first collector to allow the centrifugal pump to supply the fluid at the first elevated pressure and the second elevated pressure.

10. A centrifugal turbo machine as recited in claim 1, wherein the first collector and the second collector are diametrically opposed from one another relative to the central axis of the housing.

11. A centrifugal turbo machine as recited in claim 1, wherein the plurality of circumferentially spaced apart channels are bifurcated adjacent an outer diameter of the impeller.

12. A centrifugal turbo machine as recited in claim 1, wherein the impeller is configured in such a manner so that at least 70% of the circumferentially spaced apart channels are in fluid communication with the first and second inlet areas.

13. A centrifugal pump for an engine, comprising:

a) a housing having a fluid inlet for receiving fluid at an initial pressure and an interior chamber defining a central axis;

b) an impeller disposed within the interior chamber of the housing and mounted for rotation about the central axis, the impeller defining first and second sealingly isolated inlet areas and having opposed upper and lower disk surfaces, the upper surface having a plurality of circumferentially spaced apart channels formed therein for conducting fluid from the inlet areas in a radially outward direction upon rotation of the impeller disk so as to increase fluid pressure, wherein the plurality of circumferentially spaced apart channels are intermediate the upper and lower disk surfaces;

c) a first collector formed by the housing for receiving the fluid from the first inlet area via the channels at a first elevated pressure relative to the initial pressure;

d) a second collector formed by the housing for receiving fluid from the second inlet area via the channels at a second elevated pressure relative to the first elevated pressure, the second collector being sealingly isolated from the first collector;

e) a cross-over conduit formed by the housing for conducting fluid from the first collector to the second inlet area of the impeller disk; and f) an outlet formed by the housing for conducting fluid from the second collector.

14. A centrifugal pump as recited in claim 13, wherein the first and second collectors are sealingly isolated by sealing lands defined by the housing.

15. A centrifugal pump as recited in claim 13, wherein the plurality of circumferentially spaced apart channels are adapted and configured to facilitate fluid communication between the first inlet area and the first collector, and between the second inlet area and the second collector.

16. A centrifugal pump as recited in claim 13, further comprising an inducer rotatably mounted about the central axis of the housing for drawing fluid axially from the fluid inlet to the first inlet area of the impeller disk.

17. A centrifugal pump as recited in claim 13, further comprising a partition within an inner diameter of the impeller formed by the housing for sealingly isolating the first inlet area from the second inlet area.

18. A centrifugal pump as recited in claim 17, wherein the partition further includes a flange for directing the fluid to the first inlet area and for isolating the first inlet area from the second inlet area.

19. A centrifugal pump for a gas turbine engine, comprising:

a) a housing having a fluid inlet port for receiving fluid at an initial pressure and an interior chamber defining a central axis;

b) an impeller disk disposed within the interior chamber of the housing and mounted for rotation about the central axis, the impeller disk defining first and second inlet areas and having a plurality of circumferentially spaced apart channels formed therein which extend from the inlet areas for conducting fluid in a radially outward direction upon rotation of the impeller disk so as to increase a fluid pressure;

c) an inducer, disposed within the interior chamber of the housing and mounted for rotation about the central axis to draw fluid axially, the inducer having a top portion in fluid communication with the first inlet area and a bottom portion in fluid communication with the second inlet area;

d) a first collector formed by the housing for receiving the fluid from the first inlet area via the channels at a first elevated pressure relative to the initial pressure;

e) a second collector formed by the housing for receiving fluid from the second inlet area via the channels at a second elevated pressure relative to the first elevated pressure;

f) a partition within the interior chamber of the housing for isolating the first inlet area from the second inlet area, the partition having a helical flange for isolating the top portion of the inducer from the bottom portion of the inducer;

g) a cross-over conduit formed by the housing for conducting fluid from the first collector to the second inlet area of the impeller disk; and h) an outlet formed by the housing for conducting fluid from the second collector.

20. A centrifugal pump as recited in claim 19, wherein the housing further defines sealing lands with the impeller disk for sealingly isolating the first and second collectors.

21. A centrifugal pump as recited in claim 19, wherein the plurality of circumferentially spaced apart channels are adapted and configured to facilitate fluid communication fluid between the first inlet area and the first collector, and between the second inlet area and the second collector.

22. A centrifugal pump as recited in claim 19, further comprising a second outlet in fluid communication with the first collector area for providing fluid at the first elevated pressure.

* * * * *